US009791227B2

(12) United States Patent
Hayes

(10) Patent No.: US 9,791,227 B2
(45) Date of Patent: Oct. 17, 2017

(54) DEVICE FOR MODIFICATION OF EJECTED CASINGS TRAJECTORIES

(71) Applicant: William Donald Hayes, Colorado Springs, CO (US)

(72) Inventor: William Donald Hayes, Colorado Springs, CO (US)

( * ) Notice: Subject to any disclaimer, the term of this patent is extended or adjusted under 35 U.S.C. 154(b) by 0 days.

(21) Appl. No.: 14/977,183

(22) Filed: Dec. 21, 2015

(65) Prior Publication Data

US 2016/0178301 A1 Jun. 23, 2016

Related U.S. Application Data

(60) Provisional application No. 62/095,565, filed on Dec. 22, 2014.

(51) Int. Cl.
*F41A 9/60* (2006.01)
*F41A 9/55* (2006.01)

(52) U.S. Cl.
CPC . *F41A 9/55* (2013.01); *F41A 9/60* (2013.01)

(58) Field of Classification Search
CPC ..... F41A 9/60; F41A 9/54; F41A 9/55
USPC ..... 42/98, 90; 89/33.4
See application file for complete search history.

(56) References Cited

U.S. PATENT DOCUMENTS 968,139 A * 8/1910 Febiger ..... F41A 21/08 42/106
3,153,981 A * 10/1964 Brass ..... F41A 9/60 42/98
3,881,268 A * 5/1975 Petersen ..... F41A 35/06 42/98
4,110,927 A * 9/1978 Morris ..... F41A 9/60 42/98
4,430,820 A * 2/1984 Marsh ..... F41A 9/60 42/98
4,594,803 A * 6/1986 Muncy ..... F41A 9/60 42/98
4,691,615 A * 9/1987 Brunton ..... F41A 9/54 89/33.4
4,715,141 A * 12/1987 Kohnke ..... F41A 9/60 42/98
4,903,426 A * 2/1990 Bammate ..... F41A 9/60 42/98
4,959,918 A * 10/1990 Perez ..... F41A 9/60 42/98
5,285,593 A * 2/1994 Bammate ..... F41A 9/60 42/98
5,651,208 A * 7/1997 Benson ..... F41A 9/60 42/106

(Continued)

*Primary Examiner* — Michael David
(74) *Attorney, Agent, or Firm* — Aspire IP, LLC; Yiu F. Au

(57) ABSTRACT

A device for modification of ejected casings trajectories includes a top side and a bottom side. The bottom side is configured for attachment to a location on a firearm. The location is in an expected trajectory of spent casings ejected from the firearm. The top side includes a surface facing the expected trajectory of the spent casings. The surface is configured to modify a trajectory of the spent casings by accepting an impact at an angle with each spent casing at a point of impact on the surface and deflecting the spent casings at a deflection angle. The deflection angle is dependent on the point of impact. The surface may include an angled surface or a curved surface. One side of the curved or angled surface may be raised compared to another side of the curved or angled surface.

21 Claims, 5 Drawing Sheets

(56) References Cited

U.S. PATENT DOCUMENTS 7,168,200 B2 * 1/2007 Perez ..... F41A 9/60 42/98
7,493,720 B1 * 2/2009 Householder ..... F41A 15/00 42/90
7,937,876 B1 * 5/2011 Graham ..... F41A 3/66 42/75.01
7,941,961 B1 * 5/2011 Cooper ..... F41G 11/003 42/98
8,069,767 B2 * 12/2011 Deckard ..... B64D 7/06 42/98
8,408,113 B2 * 4/2013 Ledbetter, III ..... F41A 9/60 206/3
8,434,397 B1 * 5/2013 Deckard ..... B64D 7/06 89/37.13
9,360,264 B2 * 6/2016 Rosenthal ..... F41A 9/60
2002/0007581 A1 * 1/2002 Bucciarelli ..... F41G 1/35 42/98
2002/0170224 A1 * 11/2002 Lawless ..... F41C 23/10 42/71.02
2006/0026883 A1 * 2/2006 Hochstrate ..... F41C 23/16 42/75.01
2009/0031605 A1 * 2/2009 Robinson ..... F41A 33/06 42/2
2010/0212201 A1 * 8/2010 Kincel ..... F41G 11/003 42/2
2012/0144713 A1 * 6/2012 Dubois ..... F41A 21/482 42/50
2012/0174451 A1 * 7/2012 Overstreet ..... F41A 35/06 42/16
2012/0255210 A1 * 10/2012 Devine ..... F41A 15/16 42/16
2013/0205638 A1 * 8/2013 Herring ..... F41C 27/00 42/90
2013/0219763 A1 * 8/2013 Nunes ..... F41A 15/16 42/16

* cited by examiner

DEVICE FOR MODIFICATION OF EJECTED CASINGS TRAJECTORIES

CROSS REFERENCE TO RELATED APPLICATIONS

This application claims the benefit of U.S. Provisional Application No. 62/095,565, filed Dec. 22, 2014, which is herein incorporated by reference.

BACKGROUND OF THE INVENTION

Field of the Invention

The present invention generally relates to a device for modifying ejected casings trajectories, and more particularly to an apparatus, device, and method for deflecting and dampening spent casings ejected from the firing chamber of a firearm.

Description of the Related Art

Firearms include weapons in the various barreled weapons types where the firearm works to launch one or more projectiles through the barrel of a firearm when acted by a driving force. Modern firearms usually use an integrated cartridge that includes the projectile and the driving force as the ammunition.

For example, FIG. 1 illustrates a cartridge 100 for a modern firearm. The projectile is the bullet 130 at the head of the cartridge 100. The driving force is provided by a reaction between the primer 120 and the propellant substance 140. These contents of the cartridge 100 are packed in the cartridge 100 by the casing 110. The cartridge 100 is loaded into the firing chamber of a firearm as a self-contained ammunition. The cartridge 100 is matched to the type of firearm (e.g., size, weight, caliber, etc.).

Upon being struck with force (e.g., struck by a hammer or firing pin actuated by a user of the firearm pulling the trigger), the primer 120 heats up and is pushed to the propellant substance 140. The propellant substance 140 (which can be smokeless powder) reacts chemically with the heated primer 120 to produce expanding gas, which fills the chamber of cartridge 100 and leads to the forceful expulsion of the bullet 130 through the barrel of the firearm due to the pressure from the expanding gas. Upon firing of the bullet 130 from the barrel, the cartridge 100 is emptied of the contents due to chemical reaction (e.g., conversion of the propellant substance 140 to gas) and the physical ejection of the bullet 130. The casing 110 remains in the firing chamber of the firearm and must be discarded prior to the firing of the bullet in the next cartridge.

The ejection or discharge of the spent casing (brass) from the firing chamber of the firearm may be performed manually by a user (e.g., single-action or double-action revolvers, pump-action, bolt-action, or lever-action) or automatically loading (e.g., semi-automatic or fully-automatic firearms). In automatic-loading or self-loading firearms, the spent casing is ejected from the firing chamber by various mechanical mechanisms that are either partially or fully powered by the pressure that expunged the bullet (e.g., recoil operation, blowback operation, or gas operation). The ejected spent casings from continuous operation of the firearm are non-essential to the operation of the firearm and accumulate as potentially waste products near the vicinity of the firearm.

Some firearms, such as those of the AR platform, may have brass deflectors for deflecting the spent casings ejected from the firing chamber at the side of the guns. These brass deflectors are integrated to the gun and are made of the same metal parts as the firearm.

There are deficiencies with the related art. The brass deflectors on the AR platform and other types of firearms are generally very erratic in their operation. It is hard to control the deflection angles of each ejected casings as the firearm is in continuous operation. For example, each casing may be ejected from the firing chamber at different speeds and trajectories (e.g., due to factors such as variations in the amount of propellant substance thus leading to variations in the ejection force, general lateral movements and other displacements of the firearm, operating conditions such as atmosphere pressure, humidity, etc., and other factors). Even slight variations in the casing's ejection speed and trajectory may lead to a large difference in the eventual displacement of the spent casing by the brass deflector due to the large comparative distance that ejected casing is eventually at rest (e.g., a few feet from the firearm). Basically, the spent casings are scattered all over the ground.

Another deficiency is that the firearm with the brass deflector in the related art may be designed mainly to deflect the spent casings from a user operating the firearm at a typical right-handed firing position (e.g., aligning the aim of the firearm using the right eye and operating the trigger using the right hand, where the user's center of the body may be aligned with the left side of the firearm). For example, the brass deflector may be designed to deflect to the right side of the firearm to avoid a typical right-handed user's body when operating the firearm. This may not be optimal for a typical left-handed firing position (e.g., for a left-handed user) or military users that may need to use the firearm from other positions. It is known the left-handed and military users constantly get hits and burns from the deflected spent casings (also known as "brass burns").

Yet another deficiency is that the brass deflector of the firearm in the related art are made of the same or similar metallic materials as with the firearm. For example, the brass deflector are made from metallic materials that are molded to or otherwise attached to the firearm. The molding and/or attachment to the firearm may be relatively permanent (e.g., the brass deflector is designed to be attached to the firearm for prolong usage and not designed to be replaced for the lifetime of the firearm). The metallic brass deflector is painted or coated over for appearance and to protect the metallic material. Consequently, the repeated contact of ejected casings with the brass deflector causes damage to the paint or coating and/or even the metallic materials of the brass deflector itself. This results in at least the general unsightliness of the a firearm with damaged looking brass deflector due to the damage to the paint. Further problems may develop from the actual damage of the brass deflector in effectively and accurately deflecting spent casings (e.g., due to scratches, dents, and other damages to the surface or structural integrity of the brass deflector affecting the correct operation (e.g., deflection trajectory) of the spent casings).

SUMMARY OF THE INVENTION

Accordingly, the invention is directed to a device for modifying ejected casing cartridge trajectories and an apparatus, device, and method for deflecting and dampening spent casing ejected from the firing chamber of a firearm that substantially obviate one or more of the problems due to limitations and disadvantages of the related art.

An advantage of an embodiment is to modify and control the speed and trajectory of the spent casing through the deflection and dampening of the spent casing by contact with the device after the spent casing is ejected from the firearm. Through controlled deflection and dampening, the spent casings would be collected in a small area close to the firearm. This further aids in the collection and clean-up after continuous operation of the firearm. This further aids in the recycling and reuse of the spent casing, thus effecting savings to costs and materials.

Another advantage of an embodiment is to facilitate the operation of the firearm from a number of various user positions for operating the firearm. Through controlled deflection, the spent casings can be deflected to a suitable area away from the user of the firearm at various operating positions. Through controlled dampening, the ejection of the spent casings can also be dampened to reduce the speed and energy from which the spent casings are deflected, thereby reducing the speed and energy of any potential contact of the spent casings with the user; this reduces episodes of "brass burns" from spent casings with sufficient speed and/or energy in a sufficiently direct trajectory when hitting the user.

Yet another advantage of an embodiment is to protect the firearm and/or existing brass deflector attached to the firearm from damage. As the device according to an embodiment attaches to the firearm and/or the existing brass deflector and would take the direct hit of the ejected casing to dampen and modify the casing's trajectory, the device absorbs the direct energy from the ejected casing. The firearm and/or existing brass deflector beneath the device would be protected from most of the energy of the ejected casing that causes damage to an otherwise unprotected firearm and/or existing brass deflector.

Additional features and advantages of the invention will be set forth in the description which follows, and in the art will be apparent from the description, or may be learned by practice of the invention. The objectives and other advantages of the invention will be realized and attained by the structure particularly pointed out in the written description and claims hereof as well as the appended figures.

According to an embodiment, a device for modification of ejected casings trajectories includes a bottom side configured for attachment to a location on a firearm, the location in an expected trajectory of spent casings ejected from the firearm and a top side including a surface facing the expected trajectory of the spent casings, the surface configured to modify a trajectory of the spent casings by one or more of dampening and deflecting the spent casings. The device comprises a polymer material. The surface may include an angled surface. One side of the angled surface may be raised compared to another side of the angled surface. The surface may include a curved surface. A contour of a curve defined by a plane at one side of the curved surface may be different than a contour of a curve defined by a plane at another side of the curved surface, and the contours of the curves defined by substantially parallel planes to the one side and the another side may be continuous across the curved surface. The device may include one or more additional surfaces, the additional surfaces include markings. The surface may include raised areas.

According to another embodiment, a device for modification of ejected casings trajectories includes a bottom side configured for attachment to a location on a firearm, the location in an expected trajectory of spent casings ejected from the firearm, and a top side including a surface facing the expected trajectory of the spent casings, the surface configured to modify a trajectory of the spent casings by accepting an impact at an angle with each spent casing at a point of impact on the surface and deflecting the spent casings at a deflection angle, the deflection angle dependent on the point of impact. The surface may include an angled surface. One side of the angled surface may be raised compared to another side of the angled surface. The surface may include a curved surface. One side of the angled surface may be raised compared to another side of the angled surface. A contour of a curve defined by a plane at one side of the curved surface may be different than a contour of a curve defined by a plane at another side of the curved surface, and wherein the contours of the curves defined by substantially parallel planes to the one side and the another side may be continuous across the curved surface. The device may include one or more additional surfaces, the additional surfaces include markings. The surface may include raised areas. The device may include a polymer material. The device may be configured to dampen the trajectory of the spent casings by absorbing at least some of the impact.

According to yet another embodiment, a method of modifying ejected casings trajectories includes attaching a bottom side of a device to a location on a firearm, the location in an expected trajectory of spent casings ejected from the firearm, and deflecting one or more of the spent casings using a top side of the device, the top side including a surface facing the expected trajectory of the spent casings, wherein the surface is configured to modify a trajectory of the spent casings by accepting an impact at an angle with each spent casing at a point of impact on the surface and deflecting the spent casings at a deflection angle, the deflection angle dependent on the point of impact. The method may further include dampening the trajectory of the spent casings by absorbing at least some of the impact using the device. The device may include a polymer material. The surface may include raised areas.

It is to be understood that both the foregoing general description and the following detailed description are exemplary and explanatory and are intended to provide further explanation of the invention as claimed.

The phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible, utilizing, alone or in combination, one or more of the features set forth above or described in detail below.

BRIEF DESCRIPTION OF THE FIGURES

The accompanying figures, which are included to provide a further understanding of the invention are incorporated in and constitute a part of this specification, illustrate embodiments of the invention and together with the description serve to explain the principles of the invention.

DETAILED DESCRIPTION

Reference will now be made in additional detail to an embodiment of the present invention, example of which is illustrated in the accompanying figures.

Figure 1:
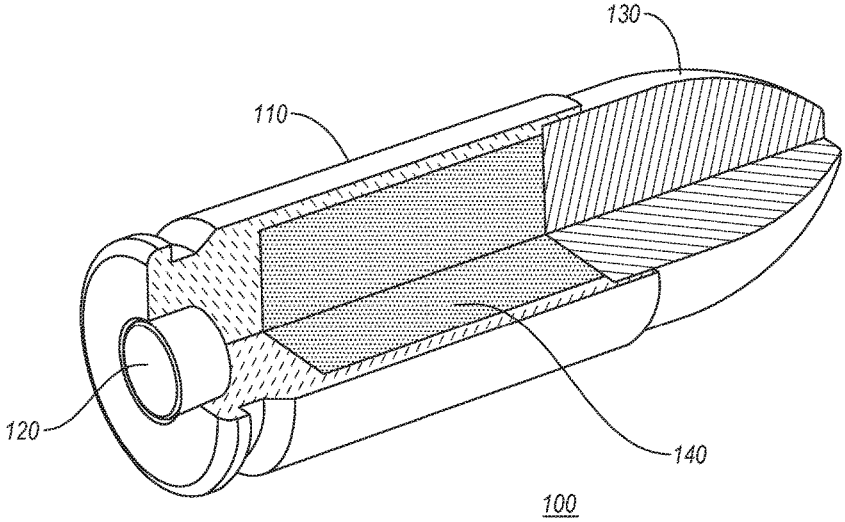
FIG. 1 illustrates an exploded view of an integrated cartridge for a firearm.
Figure 2:
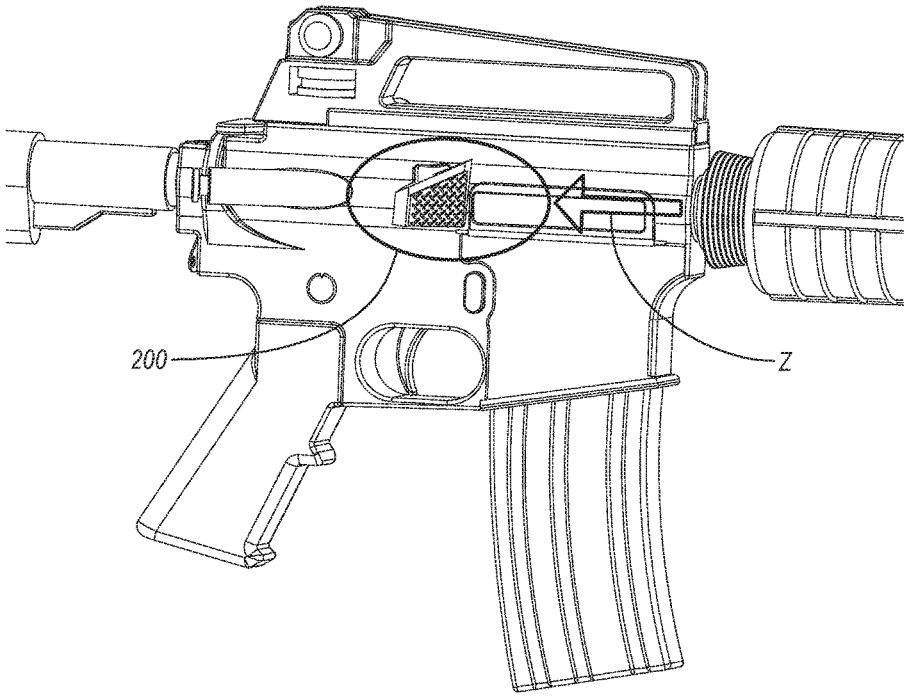
FIG. 2 illustrates a view of a device for the modification of ejected casing trajectories attached to a firearm according to an embodiment.

FIG. 2 illustrates views of a device for the modification of ejected casing trajectories attached to a firearm according to an embodiment.

Referring to FIG. 2, FIG. 2 illustrates a device for the modification of ejected casing trajectories 200 attached to the left side of the firearm (with the barrel and trigger as illustrated). Here, the spent casing after a use of the firearm would be ejected in from the firing chamber a trajectory Z to the left side and towards the front side of the firearm (e.g., towards the barrel). The device 200 may be attached to be in the expected trajectory $A_1$ of the ejected casing on the left side of the firearm in front of the firing chamber. Here, the device 200 is illustrated as being attached to a pre-existing brass deflector of the firearm. However, in another embodiment, the device 200 may be directly attached to the firearm or other attachment points (e.g., firearm stand) in the expected trajectory Z of the ejected casing.

In an embodiment, the device 200 may be made of one or a combination of various materials such as metal (e.g., steel, aluminum iron, titanium), polymer (e.g., foam, rubber, urethane, polyurethane, polystyrene, latex, silicon, plastic), organic materials (e.g., sponge, cloth type pad or base), or other suitable materials as known now or may be later derived. In a preferred embodiment, the device 200 may be made of materials and/or shape that has sufficient compressive strength (e.g., to effect dampening and/or modification of a spent casing's trajectory as the spent casing is ejected after being fired from the firearm). For example, the device 200 may be made of a polymer type material (e.g., foam) that has an internal structure filled with air pockets for being able to compress to withstand and absorb the kinetic energy (e.g., the shock) of the ejected spent casings and to be able to sufficiently return to the original shape of the device 200. In another example, the device 200 may be made of a metal type material and is shaped (e.g., shaped to a spring) such that the device 200 can compress to withstand and absorb the kinetic energy of the ejected spent casings and is able to sufficiently return to the original shape of the device 200. Further, the device 200 may be made of materials and/or shape that are sufficiently durable (e.g., able to withstand the compressive shock of the ejected spent casings and to maintain the compressive strength after substantial usage of the device 200).

It is noted that various factors of the device 200, including the hardness and other property of the material of the device 200, shape and surface of impact from the ejected casings of the device 200, and other factors, may affect the pattern and distance of deflection of the ejected casings. In an embodiment, these factors may be adjusted through design and/or testing to achieve desirable results in the pattern and distance of deflection (e.g., adjustment for different firearms and/or casings). For example, the hardness of the material (e.g., elasticity, stiffness, plasticity, strength, durometer, etc.) may affect the distance of deflection, where a softer material may be able to absorb more kinetic energy from the impact of the ejected casing and thereby reducing the distance of the deflection compared to a harder material being more repellent. However, a harder material may be more durable than a softer material, leading to higher and longer reliability of use and less frequent need for replacement of the device 200. The thickness of the device 200 may also vary depending on the need for deflection quality (e.g., distance and accuracy), durability, aesthetics, and/or other needs and may be designed and/or tested to achieve desirable results. In an embodiment, a durable coating may be applied to the device 200 for added durability and longevity for use.

In embodiments, the device 200 may be manufactured by methods as known now or may be later derived. In an embodiment, thermoforming may be used and is preferably for low volume production. In the thermoforming process, production of the device 200 may use materials such as a 2 and 101*b* Ethylene-vinyl acetate (EVA), polyethylene (PE) foam, polyurethane (PU) foam, or other suitable materials. In an exemplary thermoforming process, device 200 of suitable hardness were produced suitable for the application. In another embodiment, mass production of the device 200 may be performed using casting (e.g., resin casting, die casting) or molding (e.g., blow molding, injection molding). In a further embodiment, other methods of manufacturing may be used including 3D printing.

In an embodiment, the bottom of the device 200 (e.g., the side of the device 200 to be attached to the firearm or other fixed objects and not expected to be contacted by the ejected spent casing) may be made of and/or contain attachment materials (e.g., adhesive or other fastener materials) for the attachment to the firearm or other fixed objects. In a preferred embodiment, the attachment material may include one or a combination of pressure sensitive adhesive (PSA), adhesive transfer tape (e.g., 9775 tape by 3M), a hook and loop fastener (e.g., Velcro material). In an exemplary use, a user may be provided with a device 200 that has an adhesive backing for relatively temporary attachment to a firearm or the brass deflector (e.g., as a user modifiable part of the firearm that is not part of the original manufacturer product).

In another embodiment, the device 200 may be attached to the firearm or other fixed objects by other attachment methods (e.g., nail, screw, rivet, nut and bolt, etc.) as known now or may be later derived. In an exemplary use, a firearm may be produced (e.g., by the manufacturer) or modified (e.g., in after-market) to include the device 200 as a relatively permanent fixture. In an embodiment, the firearm may be modified by creating a hole at a place at an expected trajectory of the ejected casings, with the device 200 attached (e.g., by nail, screw, rivet, nut and bolt or other attachment methods) through the created hole.

In an embodiment, the attachment material (e.g., adhesive) and/or method (e.g., nail) may be secured to the firearm or other fixed object enough to accommodate a lateral force effected contact with the ejected casing. For example, while the device 200 is in the path of a direct trajectory of the spent casing being ejected from the firing chamber (e.g., the direct component being accommodated/absorbed by the compressive strength of the device 200), there may be a lateral component to the trajectory (and resulting in a lateral force) on the device 200. If the attachment of the device 200 to the firearm or other fixed objects is not secure enough to counter such lateral force, the attachment may break and the device 200 may be ripped or bumped off the firearm or the attached fixed object. In an embodiment for a military or other intensive application and use of the firearm, a more relatively permanent fixture (e.g., by nail, screw, rivet, nut and bolt, etc.) may be preferred to better handle the heightened need to a more secure attachment.

It is noted that the device 200 may be produced of various colors, shapes, and sizes for aesthetic reasons (e.g., for the preference of the user). For example, the device 200 may be produced with extra surfaces beyond the impact surface (the surface of the device 200 expecting impact of the spent casing), where the extra surfaces may carry labels, logos, or other brandings. In an embodiment, the device 200 may be packaged with labeling of logos and/or advertisements (e.g., packaged as a give-away item)

Figure 3A:
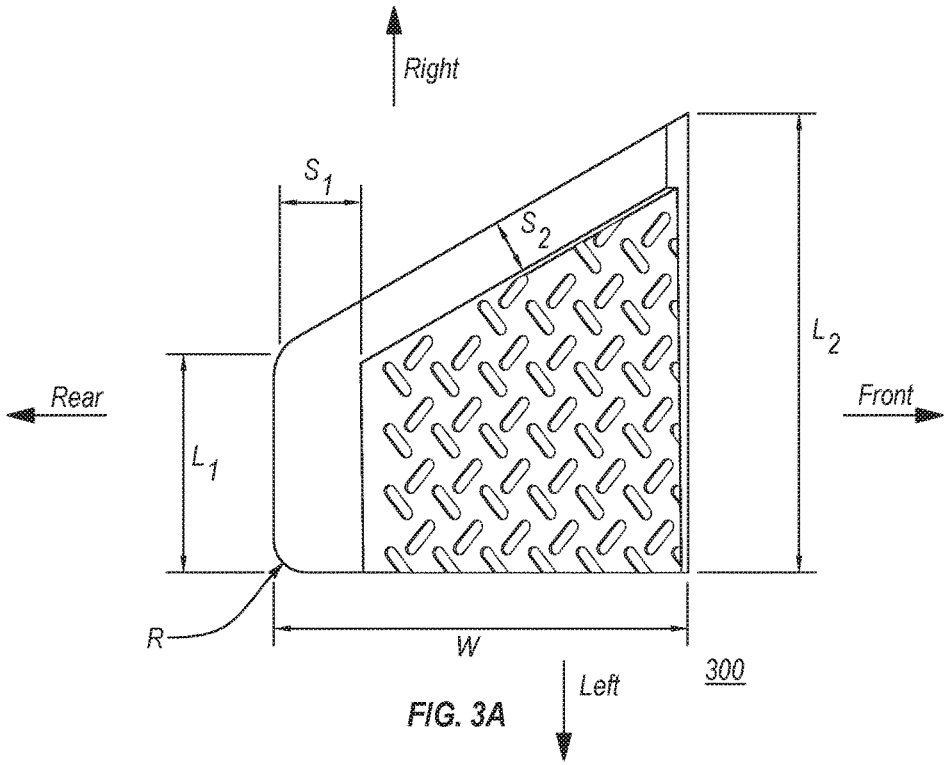
FIGS. 3A and 3B illustrate views of a device for the modification of ejected casing trajectories according to an embodiment.
Figure 3B:
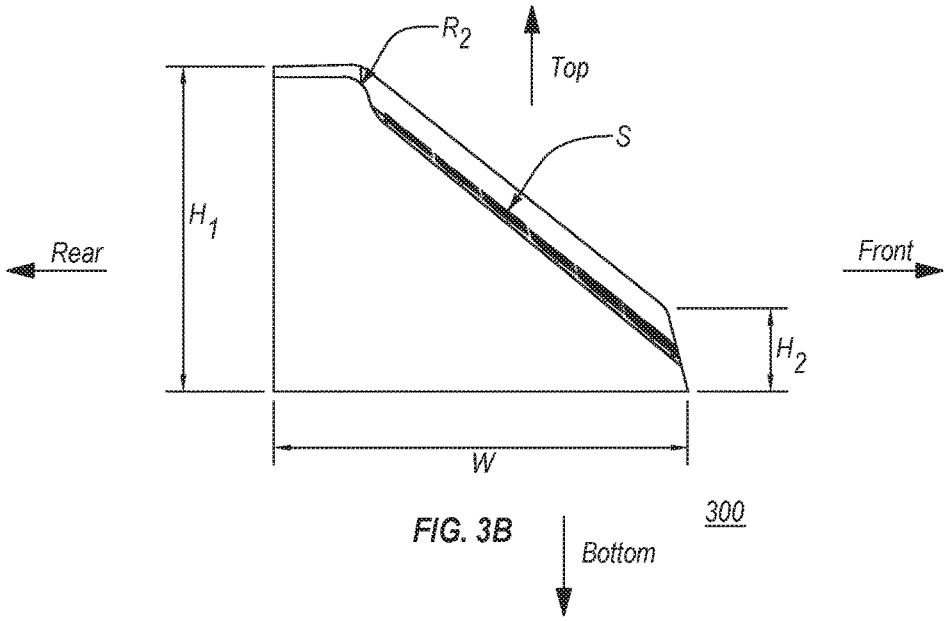

FIGS. 3A and 3B illustrate views of a device for the modification of ejected casing trajectories according to an embodiment. FIG. 3A illustrates a top view of the device 300. FIG. 3B illustrates a left view of the device 300.

Referring to FIGS. 3A and 3B, the device for the modification of ejected casing trajectories 300 includes an angled impact surface S (the surface expecting impact of the spent casing). In an embodiment, the device 300 may be attached to the firearm (or brass deflector of the firearm) or other fixed object in an expected trajectory of the ejected casings from the firing chamber of the firearm. Similar to as discussed with respect to device 200, the bottom of the device 300 may be attached through the various attachment methods, and the front of the device 300 is designed to face and make contact with the ejected casings at their expected trajectories.

The angled impact surface S on the front of the device 300 is used to modify the trajectory of the ejected casings. For example, the angled impact surface S may deflect an incoming spent casing at a trajectory substantially complement to the incoming trajectory (e.g., a complement trajectory in relation to the normal of the angled impact surface S). In an embodiment, the device 300 may be attached to the firearm or other object such that the angled impact surface S is configured to receive the impact of the ejected casing at an angle where the deflection angle (e.g., the complement angle) is to the desired direction. As discussed above with respect to device 200, device 300 may further dampen the deflected trajectory of the ejected casing (e.g., by absorbing at least some of the kinetic energy of the ejected casing) depending on the materials of the device 300 (e.g., the hardness and compressive strength) and other factors.

In an embodiment, the angled impact surface S may have a lift at one side over another side (e.g., the right side of the impact surface S being higher along the surface than the corresponding left side on a parallel plane). For example, when the device 300 is placed flat on the bottom side, the right side (including the impact surface S) may be raised by a height $H_2$. When the device 300 is installed on a right side of the firearm with the impact surface S facing the trajectory of the spent casings ejected from the right side of the firing chamber, the normal of the impact surface S may be slightly raised upward and toward the left due to the raised right side. The deflection angle (e.g., the complement angle) then may have a slightly more downward component. This may be desirable to help deflect the spent casings downward towards the ground at a shorter deflection distance (e.g., when the downward force is mostly affected by only gravity in a straight deflection scenario).

In an embodiment, the impact surface S may have raised areas (bumps) to aid the deflection and/or dampening of the ejected casings and/or for other purposes.

In an embodiment, the device 300 may include certain additional surfaces or sides (e.g., sides $S_1$ and $S_2$) that are not designed for impact and/or deflection (but may nevertheless able to do so if needed). These sides $S_1$ and $S_2$ may be used to carry labels, logos, other brandings, or for other uses as desired.

In an embodiment, the device 300 has substantially a width W of 0.681", a length $L_2$ of 0.753", a top length $L_1$ of 0.36", side widths $S_1$ and $S_2$ of 0.143", a suitable height $H_1$, a raised side height $H_2$ of 0.17", and curved edges with radius R of 0.072" and $R_2$ of 0.03125".

Figure 4A:
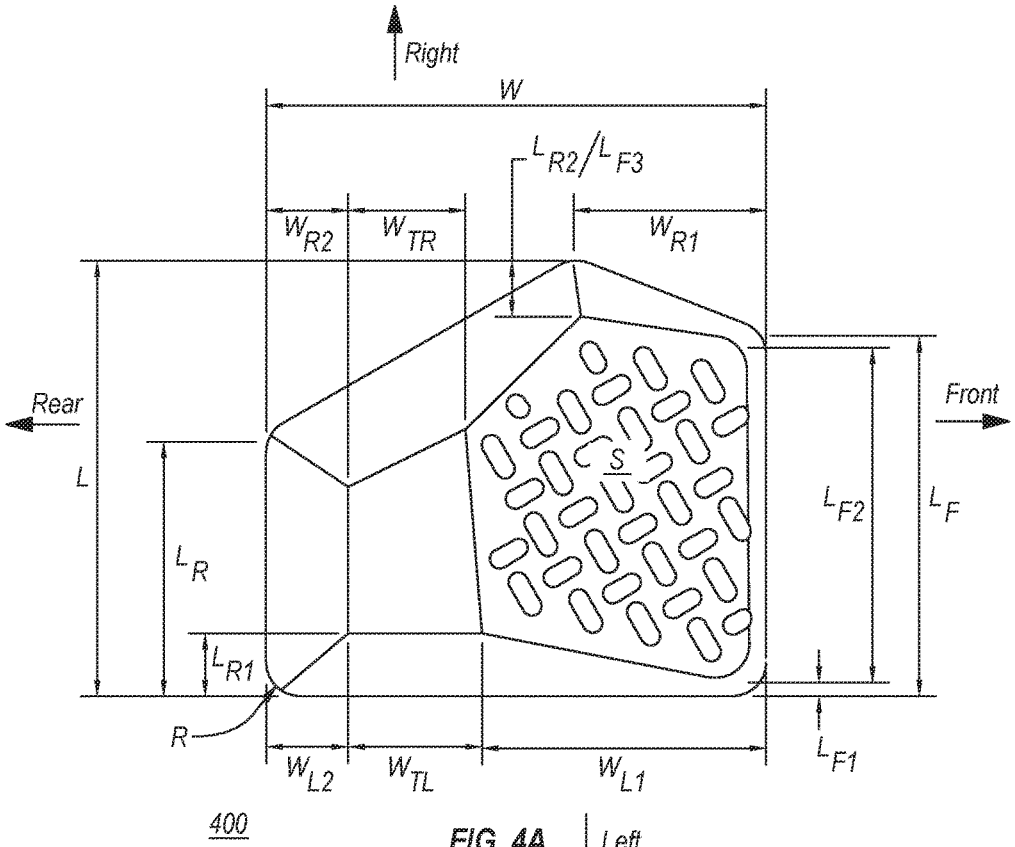
FIGS. 4A and 4B illustrate views of a device for the modification of ejected casing trajectories according to an embodiment.
Figure 4B:
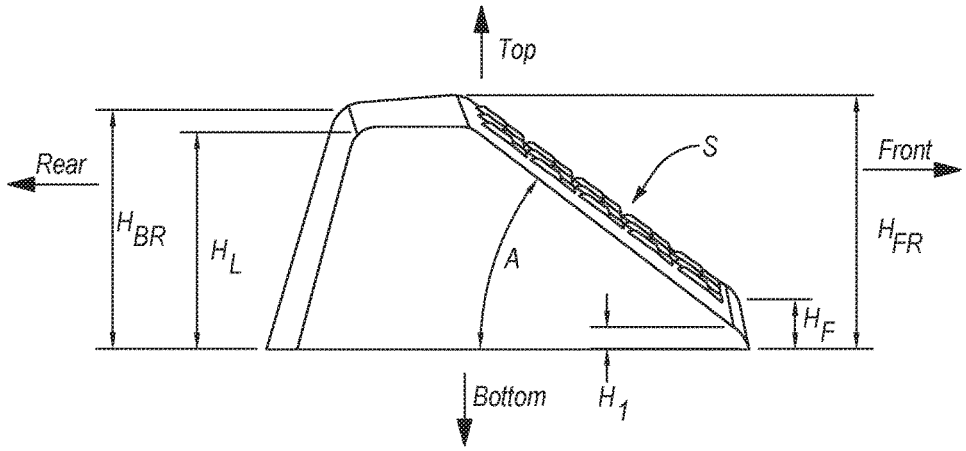
Figure 5A:
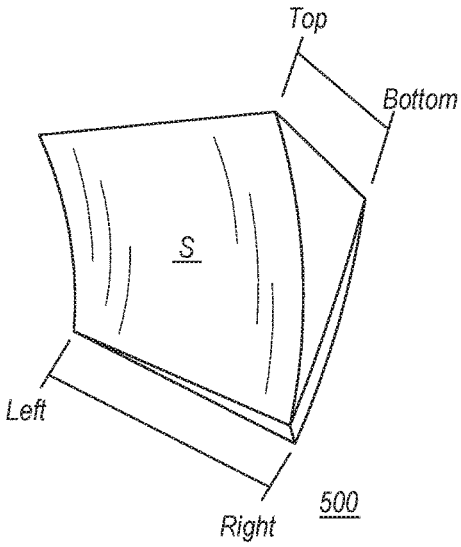
FIGS. 5A, 5B, 5C, and 5D illustrate views of a device for the modification of ejected casing trajectories according to an embodiment.
Figure 5B:
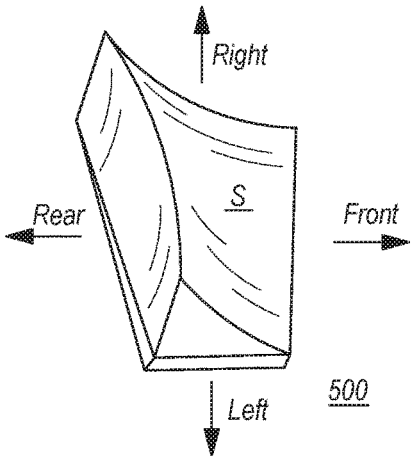
Figure 5C:
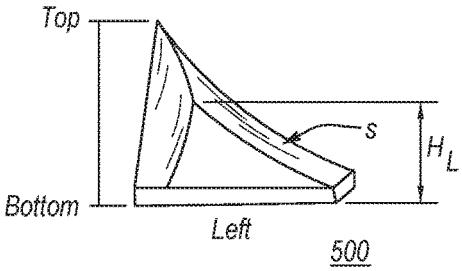
Figure 5D:
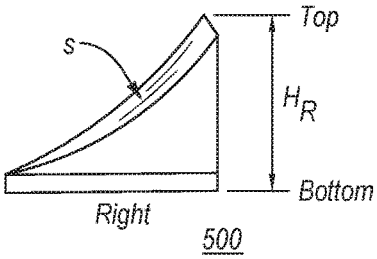

FIGS. 4A and 4B illustrate views of a device for the modification of ejected casing trajectories according to an embodiment. FIG. 4A illustrates a top view of the device 400. FIG. 4B illustrates a left view of the device 400.

Referring to FIGS. 4A and 4B, the device for the modification of ejected casing trajectories 400 includes an angled impact surface S (the surface expecting impact of the spent casing) with an angle A on the left edge of the impact surface S (and the device 400) to the bottom of the device 400. In an embodiment, the device 400 may be attached to the firearm (or brass deflector of the firearm) or other fixed object in an expected trajectory of the ejected casings from the firing chamber of the firearm. Similar to as discussed with respect to devices 200 and 300, the bottom of the device 400 may be attached through the various attachment methods, and the front of the device 400 is designed to face and make contact with the ejected casings at their expected trajectories.

The angled impact surface S on the front of the device 400 is used to modify the trajectory of the ejected casings. For example, the angled impact surface S may deflect an incoming spent casing at a trajectory substantially complement to the incoming trajectory (e.g., a complement trajectory in relation to the normal of the angled impact surface S). In an embodiment, the device 400 may be attached to the firearm or other object such that the angled impact surface S is configured to receive the impact of the ejected casing at an angle where the deflection angle (e.g., the complement angle) is to the desired direction. As discussed above with respect to devices 200 and 300, device 400 may further dampen the deflected trajectory of the ejected casing (e.g., by absorbing at least some of the kinetic energy of the ejected casing) depending on the materials of the device 400 (e.g., the hardness and compressive strength) and other factors.

In an embodiment, the angled impact surface S may be defined by a slightly lifted top corner of one side of the angled impact surface S. For example, when the device 400 is placed flat on the bottom side, the top right corner of the impact surface S may have a height $H_{FR}$ (as compared with a height $H_L$ of the top left corner of the impact surface S). When the device 400 is installed on a right side of the firearm with the impact surface S facing the trajectory of the spent casings ejected from the right side of the firing chamber, the normal of the impact surface S may be slightly raised upward and toward the left due to the raised right side. The deflection angle (e.g., the complement angle) then may have a slightly more downward component. This may be desirable to help deflect the spent casings downward towards the ground at a shorter deflection distance (e.g., when the downward force is mostly affected by only gravity in a straight deflection scenario).

In an embodiment, the impact surface S may have raised areas (bumps) to aid the deflection and/or dampening of the ejected casings and/or for other purposes.

In an embodiment, the device 400 may include certain additional surfaces or sides (e.g., sides defined by $W_{R1}$, $W_{R2}$, $W_{L2}$, $L_{R1}$, and $L_{R2}/L_{F3}$) that are not designed for impact and/or deflection (but may nevertheless able to do so if needed). These sides defined by, $W_{R2}$, $W_{L2}$, $L_{R1}$, and $L_{R2}/L_{F3}$ may be used to carry labels, logos, other brandings, or for other uses as desired.

In an embodiment, the device 400 has substantially a length L of 0.6", a width W of 0.68", a height at the front-right corner $H_{FR}$ of 0.37", a height at the rear-right corner $H_{BR}$ of 0.35", and a height at the left side $H_L$ of 0.31". The angled impact surface S has substantially a length $L_{F1}$ of 0.48", a width $W_{L1}$ of 0.37", a height following $H_{FR}$ and $H_L$ at the respective corners, and the straight portions between the bottom of the angled impact surface S and the bottom of the device 400 has substantially heights between $H_1$ of 0.03" and $H_F$ of 0.08". This create an angle A of 37.59 degrees between the angled impact surface S and the bottom of the device 400. The height of the rear-right corner at the top of the device 400 $H_{BR}$ is substantially 0.35". The sides as defined by the various dimensions are substantially $L_R$ of 0.36", $L_{R1}$ of 0.08", $W_{L2}$ of 0.1", $W_{TL}$ of 0.21", $W_{L1}$ of 0.37", $L_{F1}$ of 0.01", $L_F$ of 0.5", $L_{F2}$ of 0.48", $W_{R1}$ of 0.26", $L_{R2}/L_{F3}$ of 0.08", $W_{TR}$ of 0.17", and $W_{R2}$ of 0.11". The radius R of curved edges is substantially 0.047".

FIGS. 5A, 5B, 5C, and 5D illustrate views of a device for the modification of ejected casing trajectories according to an embodiment.

Referring to FIGS. 5A-5D, the device for the modification of ejected casing trajectories 500 includes a curved impact surface S (the surface expecting impact of the spent casing) concavely curved (convex towards the device 500 and the bottom of the device 500). In an embodiment, the device 500 may be attached to the firearm (or brass deflector of the firearm) or other fixed object in an expected trajectory of the ejected casings from the firing chamber of the firearm. Similar to as discussed with respect to devices 200, 300, and 400, the bottom of the device 500 may be attached through the various attachment methods, and the front of the device 500 is designed to face and make contact with the ejected casings at their expected trajectories.

The curved impact surface S on the front of the device 500 is used to modify the trajectory of the ejected casings. For example, the curved impact surface S may deflect an incoming spent casing at a trajectory substantially complement to the incoming trajectory (e.g., a complement trajectory in relation to the normal to the contour of the curved impact surface S at the position of the impact). In an embodiment, the device 500 may be attached to the firearm or other object such that the curved impact surface S is configured to receive the impact of the ejected casing at an angle where the deflection angle (e.g., the complement angle) is to the desired direction. As discussed above with respect to devices 200, 300, and 400, device 500 may further dampen the deflected trajectory of the ejected casing (e.g., by absorbing at least some of the kinetic energy of the ejected casing) depending on the materials of the device 500 (e.g., the hardness and compressive strength) and other factors.

In an embodiment, the curved impact surface S may be defined by the two sides (e.g., left and right sides) of the device 500, with one side having a larger area (and may have a larger height than the other). This would have an effect on the shape of the curved impact surface S, where the contour of the curve at each cross-section (plane) parallel to each of the sides (e.g., left and right sides) would follow a gradient between the contour of the curves from one side to the other side (e.g., the contour of the curve of the right side has a different curvature than the contour of the curve of the left side, and the contour of the curves in parallel planes of the curved impact surface S would fill in with continuous change of the difference between the different curvatures of the left and right side). Practically, this results in different deflection angles when the ejected casing contact the device 500 at various locations of the curved impact surface S. For example, the device 500 may be placed flat on the bottom side, and the right side of the device 500 is larger than the left side. When the device 500 is installed on a right side of the firearm with the curved impact surface S facing the trajectory of the spent casings ejected from the right side of the firing chamber, an impact of an ejected casing towards the larger right side of the device 500 may have a smaller deflection angle (e.g., due to the relatively smaller curvature the curved impact surface S of the larger right side) than an impact towards the smaller left side, which may have a larger deflection angle (e.g., due to the relatively larger curvature of the curved impact surface S of the smaller left side). This may result in ejected casings impacting at near each of the right and left sides to be deflected to similar locations on the ground (e.g., because the left side is farther from the firing chamber where the spent casings are ejected, a spent casing impacting towards the left side may have a larger angle relative to the normal of the impact surface S; this results in a similarly larger deflection angle than an impact to the right side if the impact surface S is a straight flat surface like in the devices 300 and 400).

In an embodiment, the impact surface S may have raised areas (bumps) to aid the deflection and/or dampening of the ejected casings and/or for other purposes.

In an embodiment, the device 500 may include certain additional surfaces or sides that are not designed for impact and/or deflection (but may nevertheless able to do so if needed). These sides may be used to carry labels, logos, other brandings, or for other uses as desired.

In an embodiment, the height $H_L$ on a side (e.g., the left side) is substantially ⅜", and the height $H_{FR}$ on a side (e.g., the right side) is substantially 7/16".

Testing Data and Results

Embodiments of the device (e.g., device 300 and device 400) being attached to a firearm was tested in comparison with a firearm without the device attached. The firearm used was a Colt Competition 223 AR15. The cartridges used were Winchester 223 Remington 55 grain Full Metal Jacket. The firearm was operated by a user from a rifle mount on a table, at a height of 39" at the ejection port. The firearm was tested by firing 30 rounds each with and without the device, with results for device 300 as list in Table 1.

TABLE 1

| Deflection Distance Without Device | Deflection Distance With Device |
|---|---|
| 8' 1" | 2' 6" |
| 8' 7" | 2' 3" |
| 9' 7" | 2' 6" |
| 7' 9" | 2' 6" |
| 9' 4" | 2' 11" |
| 8' 10" | 2' 9" |
| 9' 6" | 3' 6" |
| 8' 10" | 3' 4" |
| 8' 11" | 3' 6" |
| 10' 4" | 3' 7" |
| 7' | 3' 7" |
| 9' 1" | 3' 6" |
| 10' 2" | 3' 3" |
| 7' 5" | 3' 7" |
| 9' 7" | 2' 8" |
| 10' 4" | 2' 11" |
| 7' 11" | 4' 6" |
| 9' 8" | 3' 6" |
| 8' | 3' 10" |
| 9' | 3' 7" |
| 7' 10" | 4' |
| 9' 11" | 3' 6" |
| 8' 10" | 4' 1" |
| 9' 10" | 3' 9" |
| 8' 5" | 4' 2" |
| 10' | 3' 9" |
| 9' 5" | 4' 2" |
| 7' 10" | 4' |
| 9' 1" | 3' 10" |
| 6' 11" | 3' 2" |

From the data, the average distance of deflection without the device was 8' 10", with a standard deviation of 1'. The average distance of deflection with the device was 3' 5", with a standard deviation of 7". As such, the overall distance of deflection is reduced by 61% when the firearm was installed with the device, indicating the dampening effectiveness of the device.

The overall size of the pattern of the ejected shells as scattered on the ground was measured. The overall size of the pattern of the ejected shells resulted from the firearm without the device was 5' 7"×4'. The overall size of the pattern of the ejected shells resulted from the firearm with the device was 3' 2"×1' 4".

The angle fan pattern of the ejected shells as scattered on the ground was also measured. The angle fan pattern of the ejected shells resulted from the firearm without the device was between 90-130 degrees with an average angle of deflection being 105 degrees. The angle fan pattern of the ejected shells resulted from the firearm with the device was between 17-65 degrees with an average angle of deflection being 48 degrees.

As such, both the overall size of the pattern and the angle fan pattern of the ejected shells indicates effective accuracy and precision improvement with the device.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this description, with each claim standing on its own as a separate preferred embodiment of the disclosure.

Moreover, though the description has included a description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A device for modification of ejected casings trajectories, comprising:

a bottom side directly attached to a brass deflector of a firearm, wherein the brass deflector is in an expected trajectory of spent casings ejected from the firearm;

a top side including a surface facing the expected trajectory of the spent casings when the bottom side is attached to the brass deflector, the surface configured to modify a trajectory of the spent casings by accepting an impact at an angle with one or more of the spent casings at a point of impact on the surface and deflecting the spent casings at a deflection angle;

a proximal edge disposed near an ejection port of the firearm;

a distal edge opposite of the proximal edge; and thickness between the top side and the bottom side, wherein the thickness near the distal edge of the surface is greater than the thickness near the proximal edge of the surface.

2. The device of claim 1, wherein the surface comprises an angled surface.

3. The device of claim 1, wherein the surface comprises a curved surface.

4. The device of claim 2, wherein one side of the angled surface is raised compared to another side of the angled surface.

5. The device of claim 3, wherein a contour of a curve defined by a plane at one side of the curved surface is different than a contour of a curve defined by a plane at another side of the curved surface, and wherein the contours of the curves defined by substantially parallel planes to the one side and the another side is continuous across the curved surface.

6. The device of claim 2, wherein the device comprises one or more additional surfaces, the additional surfaces include markings.

7. The device of claim 2, wherein the surface comprises raised areas.

8. The device of claim 2, comprising a polymer material.

9. The device of claim 2, wherein the device is configured to dampen the trajectory of the spent casings by absorbing at least some of the impact.

10. A device for modification of ejected casings trajectories, comprising:

a bottom side directly attached to a brass deflector of a firearm, wherein the brass deflector is in an expected trajectory of spent casings ejected from the firearm;

a top side including a surface facing the expected trajectory of the spent casings when the bottom side is attached to a deflector component, the surface configured to modify a trajectory of the spent casings by accepting an impact at an angle with one or more of the spent casings at a point of impact on the surface and deflecting the spent casings at a deflection angle;

a proximal edge disposed near an ejection port of the firearm;

a distal edge opposite of the proximal edge; and thickness between the top side and the bottom side, the thickness comprising a polymer material, wherein the thickness near the distal edge of the surface is greater than the thickness near the proximal edge of the surface.

11. The device of claim 10, wherein the surface comprises an angled surface.

12. The device of claim 10, wherein the surface comprises a curved surface.

13. The device of claim 11, wherein one side of the angled surface is raised compared to another side of the angled surface.

14. The device of claim 10, wherein the surface comprises raised areas.

15. The device of claim 10, wherein the device is configured to dampen the trajectory of the spent casings by absorbing at least some of the impact.

16. A device for modification of ejected casings trajectories, comprising:

a bottom side directly attached to a brass deflector of a firearm, wherein the brass deflector is in an expected trajectory of spent casings ejected from the firearm;

a top side including an external surface facing the expected trajectory of the spent casings when the bottom side is attached to the brass deflector, the surface configured to modify a trajectory of the spent casings by accepting an impact at an angle with one or more of the spent casings at a point of impact on the surface and deflecting the spent casings at a deflection angle;

a proximal edge disposed near an ejection port of the firearm;

a distal edge opposite of the proximal edge; and thickness between the top side and the bottom side, wherein the thickness near the distal edge of the surface is greater than the thickness near the proximal edge of the surface.

17. The device of claim 16, wherein the surface comprises an angled surface.

18. The device of claim 17, wherein one side of the angled surface is raised compared to another side of the angled surface.

19. The device of claim 16, wherein the surface comprises raised areas.

20. The device of claim 16, comprising a resilient material.

21. The device of claim 16, wherein the device is configured to dampen the trajectory of the spent casings by absorbing at least some of the impact.

* * * * *